United States Patent [19]

Walmer et al.

[11] 4,216,608

[45] Aug. 12, 1980

[54] DOLL HOUSE

[76] Inventors: Harry E. Walmer, 721 N. Overlook Dr., Alexandria, Va. 22305; Judd Horbaly, 125 Commonwealth Ave., Alexandria, Va. 22309

[21] Appl. No.: 3,519

[22] Filed: Jan. 15, 1979

[51] Int. Cl.[2] ..... A63H 33/52

[52] U.S. Cl. ..... 46/19

[58] Field of Search ..... 46/13, 19, 20, 21, 12; 272/11

[56] References Cited

U.S. PATENT DOCUMENTS

| | | | |
|---|---|---|---|
| 739,669 | 9/1903 | Grimm | 46/21 |
| 1,569,066 | 1/1926 | Beiger | 46/19 |
| 3,906,659 | 9/1975 | Walmer | 46/19 |
| 3,996,693 | 12/1976 | Walmer | 46/19 |
| 4,018,001 | 4/1977 | Walmer | 46/19 |
| 4,021,960 | 5/1977 | Walmer | 46/19 |
| 4,094,090 | 6/1978 | Walmer | 46/19 |

FOREIGN PATENT DOCUMENTS

| | | | |
|---|---|---|---|
| 640199 | 7/1950 | United Kingdom | 46/21 |

*Primary Examiner*—Louis G. Mancene
*Assistant Examiner*—Wenceslao J. Contreras
*Attorney, Agent, or Firm*—James Creighton Wray

[57] ABSTRACT

The invention relates to a doll house having a unique construction of an interlocking front wall and door assembly and an adjacent bay window. The doll house is of the collapsible type having a novel design in its construction. It is constructed of a small number of individual panels which comprise the walls, floors, roof, etc. and a bay window assembly. The panels are provided with grooves and slots so that all the panels slide together easily and support one another. No tools or screws are required for construction and the parts are locked tightly together in a rigid structure by the simple insertion of several small pegs in matching holes provided in the various panels. The doll house has various functional and decorative features including a chimney, rectangular decorative members and an address sign over the main doorway.

10 Claims, 11 Drawing Figures

393
546
548
534
549
545
535
547

363
56
506
626
631
632
633
621
65
640
451
9
623
8
50
53
21
624
59
393
505

53
544
532
539
537
540
691
538
536
531
533
549
535
534

532
539
542
538
540
541
534

544
690
532

544
690
534
549

DOLL HOUSE

INTRODUCTION

This invention relates to a doll house of the knock-down or collapsible type of simplified construction capable of being easily constructed or taken apart.

Although there are many types of doll houses which provide recreation and education to children and adults, many of them are of the permanent type and present problems with shipping and storage. Others, which are of the knock-down type, are relatively complicated in construction and require various types of fasteners and locking members to hold the doll house together. These doll houses, for the most part require the use of tools and screws for their construction and lack the rigidity that is desired in a doll house when constructed. Furthermore, more sturdy types of doll house, which can be easily knocked-down, are desired by various adult hobbyists. These doll houses are required to have open access to the various floors in order that the hobbyists can set up various furniture arrangements, etc. Interior decorators also find the doll houses useful in planning the furniture arrangements, etc., of rooms. In particular, it has been desirable to have a doll house with a large number of rooms to provide for a large number of furniture arrangements, etc. The unique design of the present doll house provides a doll house which includes a plurality of rooms and provides a novel bay window construction for the doll house. In addition, the doll house includes a novel construction whereby the entranceway is attached to the doll house by a slide and groove means.

Applicant has developed a unique series of doll houses capable of being knocked-down as represented by U.S. Pat. Nos. 3,906,659; 3,996,693; 4,021,960; 4,018,001 and 4,094,090.

BRIEF SUMMARY OF THE INVENTION

This invention relates to a doll house of the knock-down or collapsible type of simplified construction, capable of being easily constructed or taken apart for convenient storage. A unique design provides for a front entrance which interlocks with the front wall of the doll house, a novel bay window construction, and a large number of rooms from a minimum number of extended floor and wall panels provided with grooves and slots so that all parts slide together easily and support one another. The assembling of the doll house is easily done in minutes and does not require the use of tools or screws. Once assembled, all the parts are locked together by the insertion of several small pegs between adjacent parts to provide a rigid structure.

It is, therefore, an object of this invention to provide a doll house having a unique construction design capable of being easily assembled or constructed without special skill or the use of various tools and fasteners, which can be easily disassembled or knocked-down for storage or transport purposes.

Another object of this invention is to provide a doll house constructed from a novel arrangement of floor and wall panels provided with grooves and slots whereby assembly or disassembly of the doll house is facilitated.

Another object of this invention is to provide a novel floor construction for a doll house whereby additional rooms are provided for the doll house.

Another object of this invention is to provide a doll house that is relatively rigid and sturdy in construction when assembled requiring only simple pegs for holding the assembled house together.

Another object of this invention is to provide a novel front door construction in the front wall of the doll house.

A further object of this invention is to provide a novel bay window construction in the front wall of the doll house.

Other objects, advantages and features of the invention will become apparent from the following detailed description of a preferred embodiment of the invention when considered with the accompanying drawings.

DETAILED DESCRIPTION OF THE DRAWINGS

Figure 1:
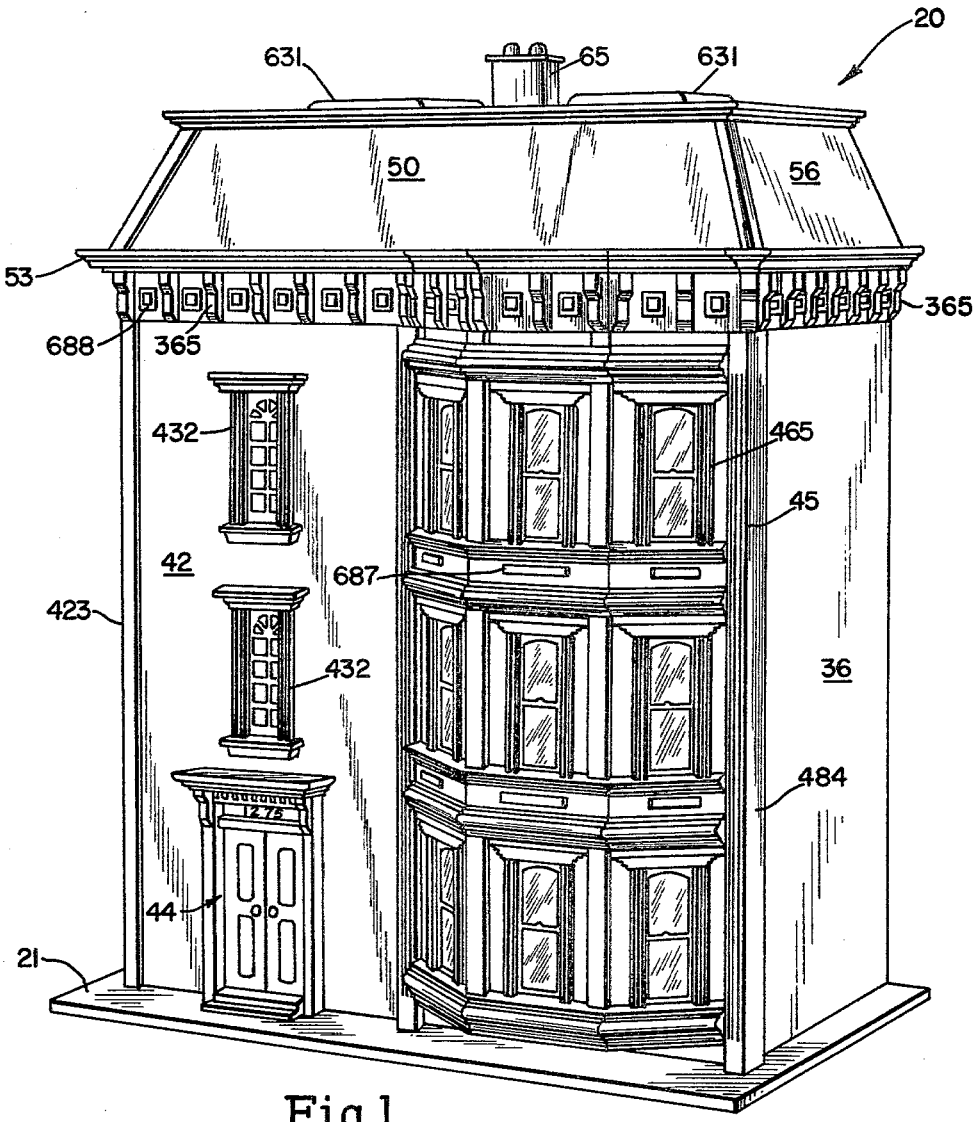
FIG. 1 is a perspective front view of the doll house as fully assembled embodying the novel aspects of the invention.
Figures 2, 3, 4, 5, 5A, 6:
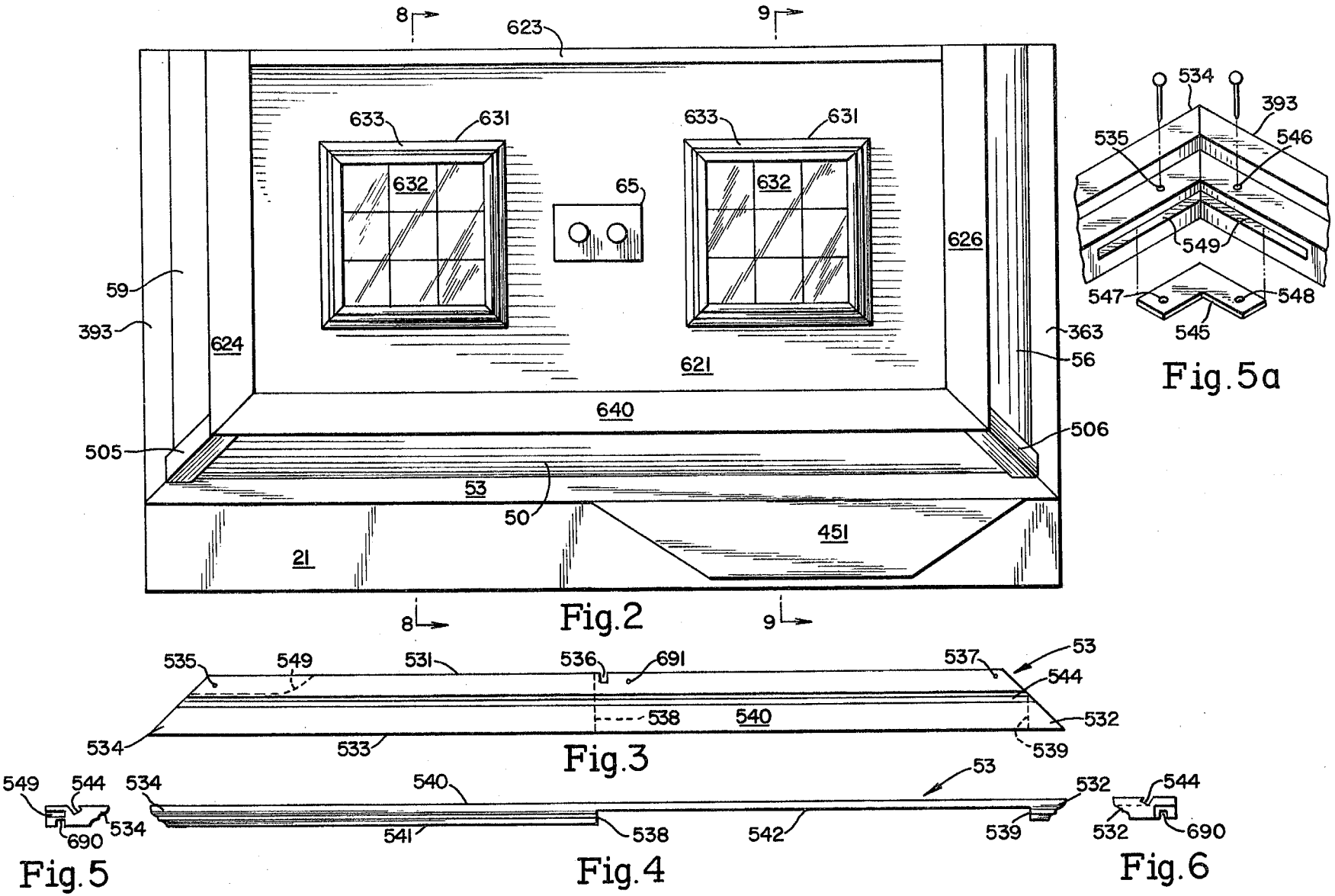
FIG. 2 is a perspective top view of the doll house showing the novel features of the roof.
FIG. 3 is a perspective top view of the continuous front molding of the doll house.
FIG. 4 is a front edge view of the continuous front molding of FIG. 3.
FIG. 5 is a right end view of the continuous front molding of FIG. 3.
FIG. 5*a* is a perspective inner view of the right corner of the base of the roof showing the novel securing means thereof.
FIG. 6 is a left end view of the continuous front molding of FIG. 3.
Figure 7:
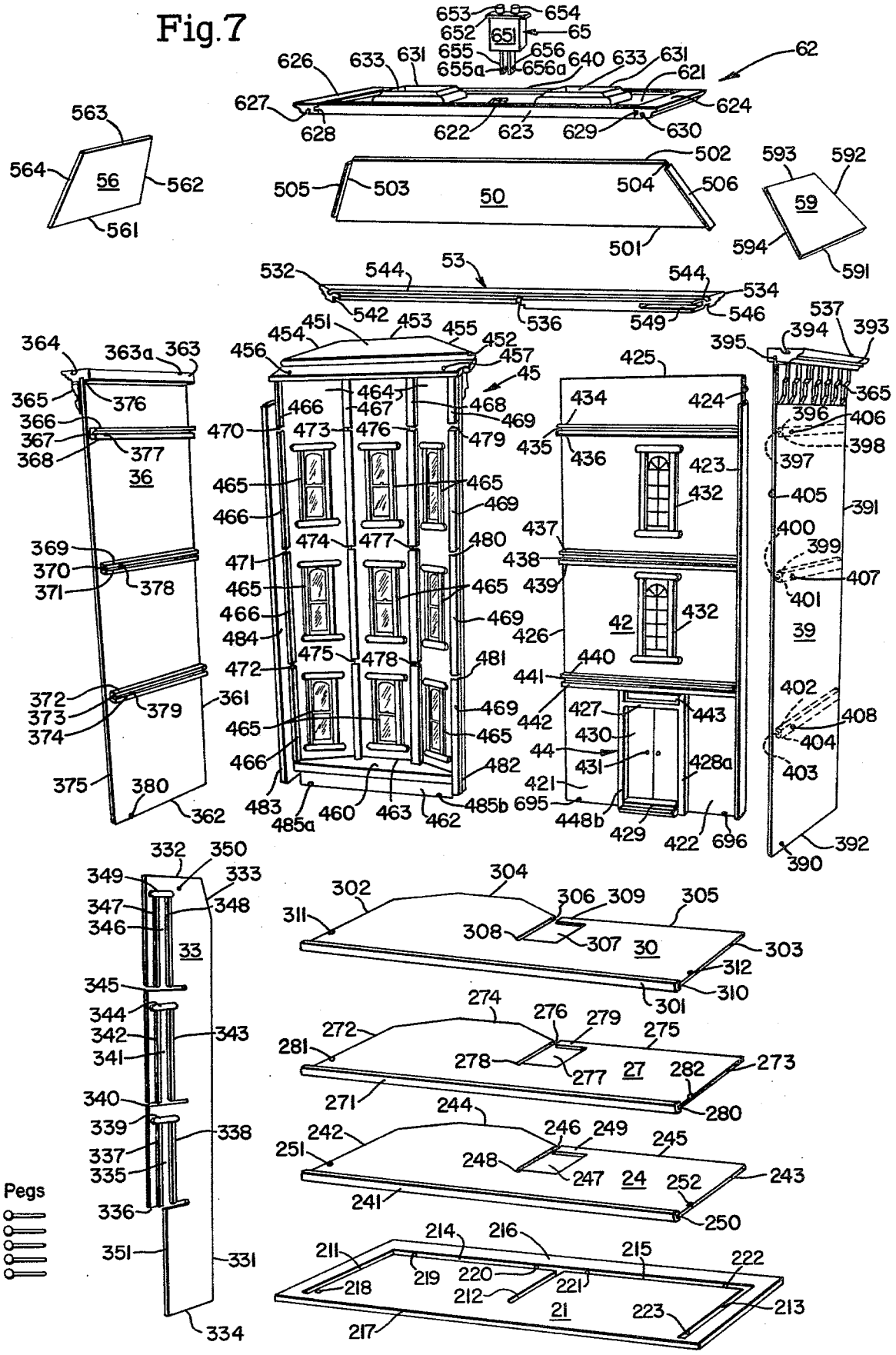
FIG. 7 is an exploded perspective fragmentary view as seen from the rear, disclosing front, left and right side walls as well as the floors, roof, bay window and various parts of the doll house.

Referring to the drawings, FIG. 1 shows a perspective generally front view of a doll house embodying the principles of the invention. FIG. 1 shows the doll house fully assembled and ready for use as a recreational device or as a model house for display purposes with furniture arrangements, etc. FIG. 2 is a perspective top view of the doll house of FIG. 1. FIG. 7 is an exploded perspective rear view disclosing the various parts of the doll house and the manner in which the parts are assembled together.

The doll house comprises a rectangular base or first floor member 21 having grooves 211, 212, 213, 214 and 215 in the top surface, and peg holes 218, 219, 220, 221, 222 and 223. A left side wall member 36 comprises between edge 362, front edge 361, rear edge 375, an integral second floor horizontal beam member 374 containing a groove 373 and peg hole 379, an integral third floor horizontal beam member 371 containing a groove 370 and peg hole 378, and an integral fourth floor horizontal beam member 368 containing a groove 367 and peg hole 377. The top portion of the left wall comprises left molding member 363 with groove 376 and slanted groove 364. Similarly, a right side wall member 39 comprises bottom edge 392, front edge 391, rear edge 405, integral second floor horizontal beam member 404 with groove 403 and peg hole 408, integral third floor horizontal beam member 401 with groove 400 and peg hole 407, integral fourth floor horizontal beam member 398 with groove 397 and peg holes 406 and right molding member 393 with groove 395 and slanted groove 394.

A front wall member 42 comprises top edge 425, bottom edge 442, right side edge 424, left side edge 426, integral L-shaped right corner beam 423, inner front wall edges 421*a* and 422*a*, an integral second floor horizontal beam member 440 containing a groove 441, an integral third floor horizontal beam member 437 containing a groove 438, an integral fourth horizontal beam member 434 containing a groove 435 and peg holes 695 and 696. Windows 432 and doorway assembly 44 are also disposed in the front wall member.

Figure 10:
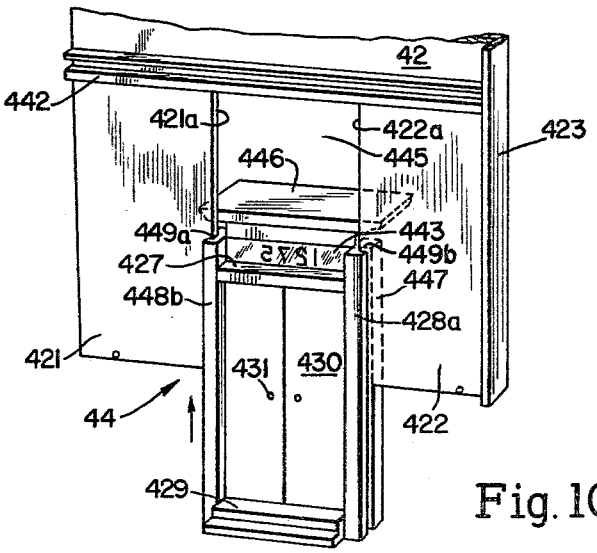
FIG. 10 is an enlarged perspective rear view of the door and interlocking front wall.

The doorway assembly 44, shown in FIG. 10, comprises door side members 428*a* and 448*b*, step member 429, door members 430, door overhang member 446 and cross member 427. Doorway assembly 44 attaches to front wall member 42 by sliding inner front wall edges 421*a* and 422*a* into inner grooves 449*a* and 449*b*, respectively, of door side members 428*a* and 448*b*, as shown in FIG. 10.

A front bay window member 45 comprises top bay member 451, with peg holes 456*a*, 456*b* and 457, right edge 482, left corner beam 484 with left edge 483, bay front wall members 464, integral vertical segmented beam members 466, 467, 468 and 469, bottom bay member 460 with vertical support member 462 and peg holes 485*a* and 485*b*. Windows 465 are disposed in bay front wall members 464. Integral vertical segmented beam members 466, 467, 468 and 469 are provided with spacings 470, 471, 472, 473, 474, 475, 476, 477, 478, 479, 480 and 481, respectively, for fitting the doll house securely together by interaction with the floor members.

An intermediate wall member 33 comprises front edge 331, rear edge 351, bottom edge 334, top edge 332, slanted front edge 333, horizontal floor slots 336, 340, 345, doors 335, 341, and 346, and peg hole 350. Door 335 comprises door side member 337 and 338 and top member 339, door 341 comprises door side members 342 and 343 and top member 344 and door 346 comprises door side members 347 and 348 and top member 349.

A second floor member 24 comprises front edge 245, front bay edge 244, rear edge molding member 241, left and right side edges 242 and 243, stair well opening 247 having open end slot 246 and slot 248, landing 249 and peg holes 251 and 252.

A third floor member 27 comprises front edge 275, front bay edge 274, rear edge molding member 271, left and right side edges 272 and 273, stair well 277 having open end slot 276 and slot 278, landing 279 and peg holes 281 and 282.

An attic or fourth floor member 30 comprises a front edge 305, front bay edge 304, rear edge molding member 301, left and right side edges 302 and 303, stair well 307 having open end slot 306 and slot 308, landing 309 and peg holes 311 and 312.

A front roof member 50 of the house comprises top edge 502, bottom edge 501 and left and right L-shaped members 505 and 506 on left and right edges 503 and 504, respectively.

A left side roof member 56 of the house comprises top edge 563, bottom edge 561, rear edge 564 and slanted front edge 562. A right side roof member 59 comprises top edge 593, bottom edge 591, rear edge 594 and slanted front edge 592.

A top roof member 62, shown in detail in FIGS. 2 and 7, comprises planar member 621, front edge molding member 640, rear edge molding member 623, left and right side edge molding members 626 and 624 with slanted grooves 627 and 630 and grooves 628 and 629, chimney opening 622, and skylights 621 with edge moldings 633 and translucent panes 632.

A chimney 65 comprises structure 651, which comprises two downwardly projecting parallel members 655 and 656 having holes, 655*a* 656*a* respectively, and top member 652 with stacks 653 and 654.

A continuous front molding member 53, shown in detail in FIGS. 3 and 4, comprises left and right slanted front side edges 532 and 534, front edge 533, rear edge 531, rear center slot 536, slanted top groove 544, cut out bottom portion 542 and peg holes 535, 691 and 537. FIG. 5*a* shows the junction at the right front corner of front molding member 53 and right molding member 393 with inner combined L-shaped groove 549 wherein L-shaped locking member 545 is secured by pegs when the doll house is assembled. FIGS. 5 and 6 show left and right end views of continuous front molding member 53 of FIG. 4 showing bottom groove 690 and slanted top groove 544.

As shown in FIG. 1, a series of decorative rectangular members 688 are placed on the exterior of the house below the front and side moldings, said decorative rectangular members being disposed between decorative member 365.

The various parts of the doll house are adapted to be assembled together and held together with pegs. The assembly of the doll house is initiated by placing the wall members in the grooves of first floor member 21. Before doing so the doorway assembly 44 is introduced in the front wall by sliding the doorway assembly into the front wall. This is accomplished by sliding inner front wall edges 421*a* and 422*a* into grooves of door side members 428*b* and 428*a*, respectively. The bottom edge 422 of front wall member 42 is then inserted in groove 215 of the first floor member 21 and vertical support member 462 of bay window member 45 is inserted in groove 214 of the first floor 21. Bottom edges 362 and 392 of side walls 36 and 39 are inserted in grooves 211 and 213, respectively. The front edges 361 and 391 of walls 36 and 39 fit within left corner beam 484 and right corner beam 423, respectively. The three walls are retained in place by inserting pegs into peg holes 380 and 390 of side walls 36 and 39 and peg hole 218 and 223 of floor 21 and into peg holes 695 and 696 of front wall 42 and peg holes 221 and 222 of floor 21. Bay window member 45 is retained in place by inserting pegs into peg holes 485*a* and 485*b* of vertical support member 462 and into peg holes 219 and 220 of floor 21.

The three walls and bay window are further retained by placing continuous molding member 53 across and abutting the top of front wall member 42 and bay window member 45 with left edge 532 abutting left molding member 363, right edge 534 abutting right molding member 393 and cut out bottom portion 542 abutting top bay member 451. Continuous molding member 53, the three wall members and bay window members are retained on the left side by inserting pegs into aligned peg holes 537 and 456*a*, aligned peg holes 363*a* and 456*b* and aligned peg holes 691 and 457. The front wall member 42 and right side wall member 39 are retained at the right front corner, as shown in FIG. 5*a*, wherein L-shaped locking member 545 is inserted into L-shaped slot 549, a peg is inserted into aligned peg holes 535 and 547 and a peg is inserted into aligned peg holes 546 and 548.

Intermediate wall 33 is next inserted from the rear of the house, in groove 212 of floor 21 and the front edge 331 is inserted in slot 536 of continuous molding member 53 at the junction of front wall member 42 and bay window member 45. Second floor member 24 is next assembled by sliding left and right side edges 242 and 243 simultaneously in groove 373 of horizontal beam member 374 and groove 403 of horizontal beam member 404 of side walls 36 and 39, respectively. The second floor member is pushed forward until its front edge 245 abuts against front wall 42 and front edge 244 abuts against bay window 45 and, in so doing the second floor is positioned with front edge portion 245 in groove 441, front edge portion 244 in spacings 472, 475, 478 and 481, and slots 246 and 248 of second floor member 24 are engaged with slot 336 of intermediate wall 33. The second floor member 24 and intermediate wall 33 are retained in place by inserting pegs in hole 251 of the second floor and hole 379 in groove 373 of horizontal beam member 374 on left side wall 36 (see FIGS. 8 and 9), and, similarly, a peg (not shown) is inserted in hole 252 of the second floor and hole 408 in groove 403 of horizontal beam member 404 on right side wall 39.

The third floor member 27 is next assembled by sliding left and right side edges 272 and 273 simultaneously in groove 370 of horizontal beam member 371 and groove 400 of horizontal beam member 401 of side walls 36 and 39, respectively. The third floor member is pushed forward until its front edge portion 275 abuts against front wall 42 and front edge portion 274 abuts against bay window 45 and, in so doing the third floor is positioned with front edge portion 275 in groove 438, front edge portion 274 in spacings 471, 474, 477 and 480 and slots 276 and 278 of third floor member 27 are engaged with slot 340 of intermediate wall 33. The third floor member 27 and intermediate wall are retained in place by inserting pegs in hole 281 of the third floor and hole 378 in groove 370 of horizontal beam member 371 on left side wall 36 (see FIGS. 8 and 9), and similarly, a peg (not shown) is inserted in hole 282 of the third floor and hole 407 in groove 400 of horizontal beam member 401 on right side wall 39.

The attic or fourth floor member 30 is next assembled by sliding left and right side edges 302 and 303 simultaneously in groove 367 of horizontal side beam 368 of side wall 36 and groove 397 of horizontal side beam 398 of side wall 39, respectively. The fourth floor member is pushed forward until its front edge portion 305 abuts against front wall 42 and front edge portion 304 abuts against bay window 45 and, in so doing the fourth floor is positioned with front edge portion 305 in groove 435, front edge portion 304 in spacings 470, 473, 476 and 479 and slots 306 and 308 of fourth floor member 30 are engaged with slot 345 of intermediate wall 33. The fourth floor member 30 and intermediate wall are retained in place by inserting pegs in hole 311 of the fourth floor and hole 377 in groove 367 of horizontal beam member 368 on left side wall 36 (see FIGS. 8 and 9), and similarly, a peg (not shown) is inserted in hole 282 of the fourth floor and hole 406 in groove 397 of horizontal beam member 398 on right side wall 39.

The roof is assembled by inserting bottom edge 501 of front roof member 50 into slanted groove 544 of continuous molding member 53. Similarly, the bottom edge 561 of side roof member 56 is inserted in slanted groove 364 of molding 363 on left side wall 36 and the bottom edge 591 of side roof member 59 is inserted in slanted groove 394 of molding 393 on right side wall 39. The roof assembly is completed by placing top roof member 62 on the front and side roof members wherein top edge 502 of front roof member 50 is inserted in slanted groove **640*a* of front edge molding member 640 (see FIGS. 8 and 9), top edge 563 of side roof member 56 is inserted in slanted groove 627 of side edge molding member 626 and top edge 593 of side roof member 59 is inserted in slanted groove 630 of side edge molding 624**.

At this stage of assembly, the roof structure is provided with means for providing rigidity by the design of the chimney structure 651 which comprises two downwardly projecting parallel members 655 and 656 (FIG. 7) having holes, **655*a* and 656*a* respectively. Opening 622 of the roof is bisected by edge 332 of intermediate wall 33. Members 655 and 656 are spaced apart a distance a little greater than the thickness of the intermediate wall 33. Chimney 65 is assembled in the roof by installing members 655 and 656 through opening 622 whereby members 655 and 656 straddle intermediate wall 33. Holes 655*a* and 656*a* are adapted to be aligned together and aligned with hole 350 of the intermediate wall when the chimney is assembled. A peg 657 (see FIGS. 8 and 9) is inserted through holes 655, 350 and 656**, which provides rigidity and stability to the roof structure.

Figure 8:
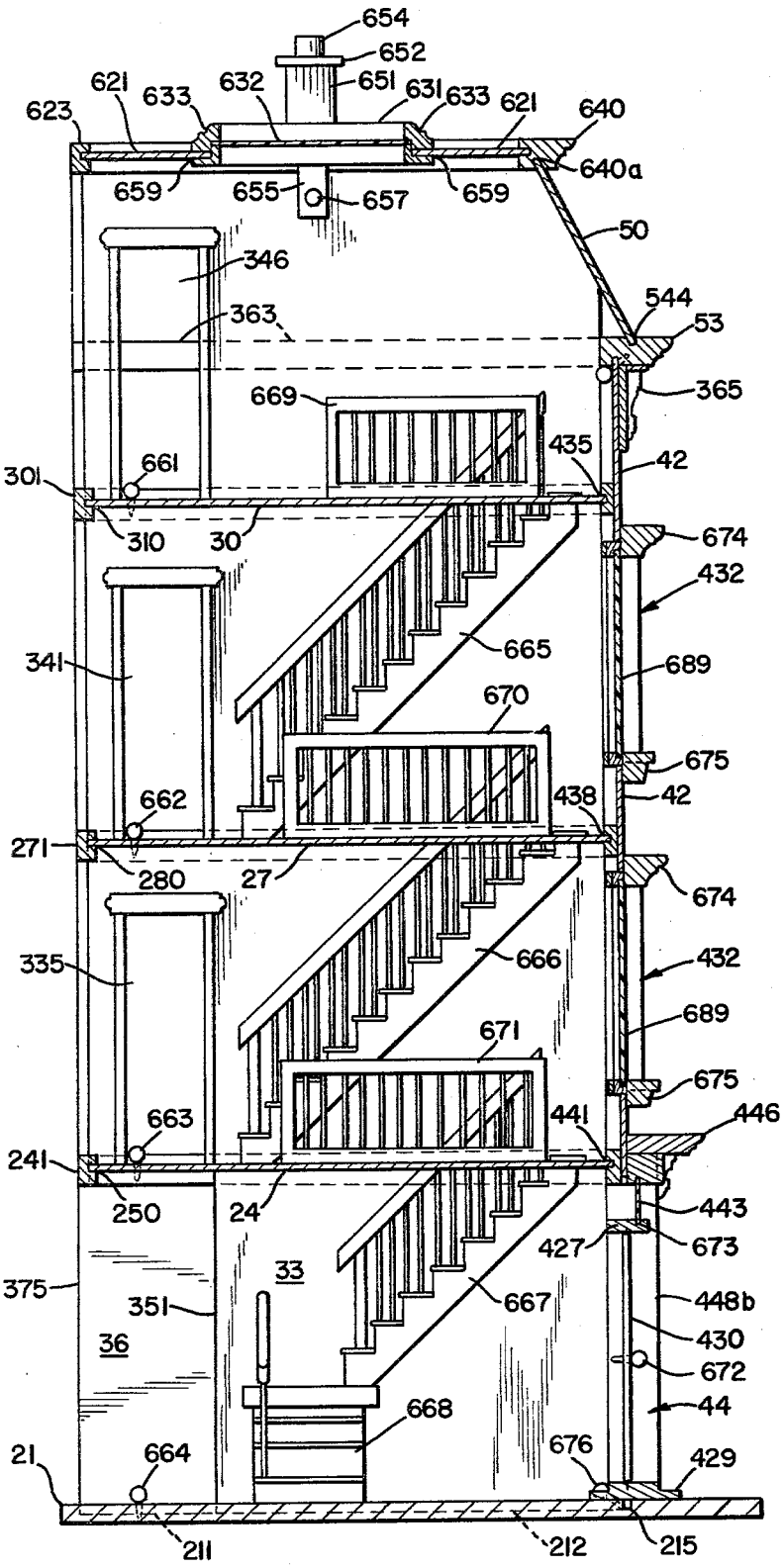
FIG. 8 is a cross-sectional view taken along line 8—8 of FIG. 2.
Figure 9:
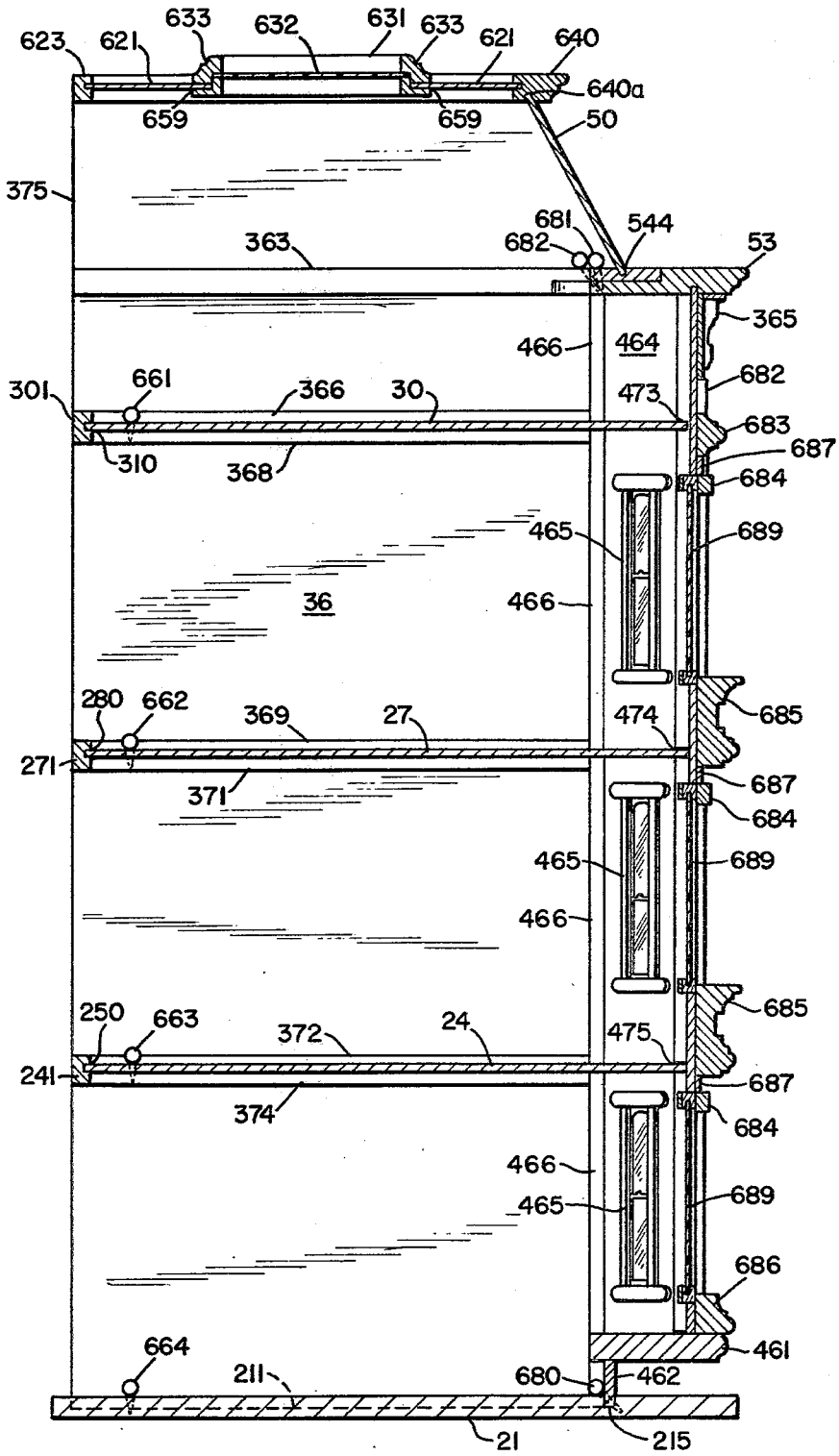
FIG. 9 is a cross-sectional view taken along line 9—9 of FIG. 2.

At this stage of assembly, the inner stairs are provided within the structure as shown in FIGS. 8 and 9. Stair case 668 is positioned to abut intermediate wall 33 and form a base for the bottom of stair case 667 when the top edge of stair case 667 is placed on landing 249 of second floor member 24. Stair case 666 is positioned with the bottom of stair case 666 abutting second floor member 24 behind stairwell 247 and the top of stair case 667 abutting third floor member 27 at landing 279. Stair case 665 is positioned with the bottom of stair case 665. abutting fourth floor member 30 and landing 309. Rails 671, 670 and 669 are placed on the second, third and fourth floors, respectively, adjacent stair wells 247, 277 and 307, respectively.

At this stage of assembly, door knobs (shown in FIG. 1) are inserted in holes 431 on door members 430. In addition, decorative rectangular members 688 may now be added.

This placement of the pegs for holding the doll house together is uniquely designed for easy assembly as well as providing the rigidity required for the doll house.

The doll house is knocked-down or disassembled by reversing the above procudure. The unique and novel design provides the benefits of knock-down construction. The use of grooves and slots provide means for easily sliding the various parts together, which support one another. The doll house is rigid in construction and all parts are held together tightly by the simple insertion of a relatively small number of strategically arranged small pegs. When disassembled, the parts of the doll house can be stacked together for easy storage or shipment.

Although the doll house of this invention has been disclosed heretofore as the preferred embodiment, wherein four rooms are available by using the one intermediate wall member 33, it is understood that the doll house can be constructed to contain more than one intermediate wall member thus providing eight or more rooms. Furthermore, the number of windows used can be more or less than shown in the preferred embodiment.

The above description of the invention is deemed to be the most practical and efficient embodiment and it should be understood that the invention is not limited to such embodiments as heretofore indicated as there could be further changes made in the arrangements, parts without departing from the principle of the present invention within the scope of the accompanying claims.

What is claimed is:

1. An easily assembled knock-down doll house having a bay window assembly and interlocking door assembly, the parts of which are fitted together and held together only with pegs comprising:

a. a generally rectangular first floor member comprising left, right and front grooves in the top surface thereof, at least one intermediate groove in said surface parallel to said left and right grooves, and a series of in-line holes disposed forward of said front groove;

b. a front wall member having a size and shape to have its bottom edge engage said front grooves of said first floor member, comprising a right vertical L-shaped side beam, at least one horizontal beam member disposed on the inner side, a cut out portion in the portion of the front wall adjacent said front grooves of said first floor member at least two holes disposed at the bottom edge and inner front wall edges disposed in the front wall member;

c. a bay window assembly having a size and shape to have its bottom edge engage said front grooves of said first floor member, comprising three non-planar bay front wall members, integral vertical segmented beam members, horizontal top and bottom bay members, a vertical bottom bay member, a left vertical L-shaped beam member and at least one window in each bay front wall member;

d. left and right side walls having respective sizes and shapes to have their front edges engage said L-shaped beams of said front wall member and bay window member and their bottom edges engage said respective left and right grooves of said first floor, each of said side walls containing second, third and fourth inner horizontal beam members having inward side grooves, molding at the top edges and a groove disposed in the molding at the terminus of said top edges;

e. at least one intermediate wall member adapted to have its lower edge engage a respective said intermediate groove in said first floor and a said vertical slot between said front wall member and bay window member, comprising at least one intermediate horizontal slot extending forwardly from the rear edge;

f. a second floor member adapted to have its side edges engage said grooves of said second inner beam members of said side walls and comprising a stairwell near the front edge and at least one horizontal slot extending rearwardly from the front edge, said slot adapted to engage said horizontal slot of said intermediate wall member;

g. a third floor member adapted to have its side edges engage said grooves of said third inner beam members of said side walls and comprising a stairwell near the front edge and at least one horizontal slot extending rearwardly from the front edge, said slot adapted to engage said horizontal slot of said intermediate wall member;

h. a fourth floor member adapted to have its side edges engage said grooves of said fourth inner beam members of said side walls and comprising a stairwell near the front edge and at least one horizontal slot extending rearwardly from the front edge, said slot adapted to engage said horizontal slot of said intermediate wall member;

i. front and left and right roof members disposed with bottom edges in a slanted groove in a molding along the base of the roof, said molding being secured to said front and side wall members, said top roof member having at least one skylight and a chimney;

j. a doorway assembly having side door members with inner grooves, step member, door members, door overhang member and cross member;

k. a continuous front molding adapted to abut and be secured to the front wall member, bay window member and side molding members of the left and right side walls; and l. a plurality of pegs adapted to be inserted in holes contained in said beams, grooves, wall and floor members at their junctures with each other for retaining said assembled structure together.

2. The doll house of claim 1, wherein the inner grooves of the side door members of the doorway assembly interlock and are retained by the inner front wall edges.

3. The doll house of claim 1, wherein the front wall member is secured to at least one side wall member by use of a L-shaped locking member inserted into an L-shaped slot within the continuous front molding and the molding of the right sidewall and secured therein by pegs placed within aligned holes.

4. The doll house of claim 1, wherein the top roof member comprises two skylights.

5. The doll house of claim 1, wherein the outer front and side walls and bay window surfaces are decorated with rectangular members.

6. The doll house of claim 1, wherein the bay window assembly has nine windows.

7. In an easily assembled knock-down type of doll house comprising front and side wall members, front, side and top roof members, intermediate wall and floor members, the improvement which comprises:

a bay window member including front wall members and integral vertical segmented beam members, said wall and beam members forming a non-planar bay window member with horizontal bay members disposed at the top and bottom of said wall and beam members, a vertical bottom bay member disposed in the first floor member in a groove in said first floor member, said top horizontal bay member disposed adjacent to and retained by a continuous molding member and having said top and bottom bay members retained by pegs disposed within said top and bottom bay members and front wall, side wall and floor members.

8. In an easily assembled knock-down type of doll house comprising front and side wall members, front, side and top roof members, intermediate wall and floor members, the improvement which comprises:

a doorway assembly including side door members with inner grooves disposed therein, stop member, door members, door overhang member and cross member, wherein inner front wall edges are disposed in side inner grooves of said side door member whereby said doorway assembly is secured by and within the front wall member.

9. In an easily assembled knock-down type of doll house comprising front and side wall members, intermediate wall and floor members, the improvement which comprises:

a continuous front molding adapted to abut and be secured to the front wall member, bay window member and side molding member of the left and right side walls.

10. In an easily assembled knock-down type of doll house comprising front and side members, intermediate wall and floor members, the improvement which comprises:

a means for securing adjacent wall members by use of a L-shaped locking member inserted into an L-shaped slot within the abutting corner moldings of the adjacent wall members; said L-shaped member secured by placing pegs in aligned holes within the moldings and L-shaped locking member.

* * * * *